US009222331B2

(12) United States Patent
Schneidmiller et al.

(10) Patent No.: US 9,222,331 B2
(45) Date of Patent: Dec. 29, 2015

(54) SYSTEM AND METHOD FOR ENHANCED SEALING OF WELL TUBULARS

(71) Applicant: OWEN OIL TOOLS, Houston, TX (US)

(72) Inventors: Kurt Schneidmiller, Burleson, TX (US); Timothy Edward LaGrange, Rainbow, TX (US); Bradley Vass, Fort Worth, TX (US)

(73) Assignee: OWEN OIL TOOLS LP, Houston, TX (US)

( * ) Notice: Subject to any disclaimer, the term of this patent is extended or adjusted under 35 U.S.C. 154(b) by 323 days.

(21) Appl. No.: 13/773,215

(22) Filed: Feb. 21, 2013

(65) Prior Publication Data

US 2014/0054048 A1 Feb. 27, 2014

Related U.S. Application Data

(60) Provisional application No. 61/601,339, filed on Feb. 21, 2012.

(51) Int. Cl.
*E21B 33/12* (2006.01)
*E21B 29/00* (2006.01)

(52) U.S. Cl.
CPC ..... *E21B 33/12* (2013.01); *E21B 29/00* (2013.01); *E21B 33/1208* (2013.01)

(58) Field of Classification Search
CPC ... E21B 23/01; E21B 33/1293; E21B 43/105; E21B 43/103; E21B 43/106; E21B 43/108
See application file for complete search history.

(56) References Cited

U.S. PATENT DOCUMENTS

| | | | | |
|---|---|---|---|---|
| 3,948,321 | A | 4/1976 | Owen et al. | |
| 5,678,635 | A * | 10/1997 | Dunlap et al. | 166/387 |
| 7,140,428 | B2 | 11/2006 | Campo et al. | |
| 2004/0069502 | A1* | 4/2004 | Luke | 166/387 |
| 2005/0056434 | A1* | 3/2005 | Watson et al. | 166/384 |
| 2011/0132623 | A1 | 6/2011 | Moeller | |

* cited by examiner

*Primary Examiner* — Blake Michener
*Assistant Examiner* — Kipp Wallace
(74) *Attorney, Agent, or Firm* — Mossman, Kumar & Tyler PC

(57) ABSTRACT

A well isolation includes a radially expandable sealing element that engages an interior wall of the wellbore tubular and a radially expandable expansion cone in telescopic relationship with the sealing element. The expansion cone expands the sealing element and a swage telescopically engages and expands the expansion cone.

15 Claims, 4 Drawing Sheets

SYSTEM AND METHOD FOR ENHANCED SEALING OF WELL TUBULARS

CROSS-REFERENCE TO RELATED APPLICATIONS

This application claims priority from U.S. Provisional Application Ser. No. 61/601,339 filed Feb. 21, 2012 the entire disclosure of which is incorporated herein by reference in its entirety.

BACKGROUND OF THE DISCLOSURE

1. Field of Disclosure

The present disclosure relates to devices and methods for isolating one or more selected zones in a wellbore.

2. Description of the Related Art

In the oil and gas industry, a well is drilled to a subterranean hydrocarbon reservoir. A casing string is then run into the well, and the casing string is cemented into place. The casing string can then be perforated and the well completed to the reservoir. A production string may be concentrically placed within the casing string. During the drilling, completion, and production phase, operators find it necessary to perform various remedial work, repair and maintenance to the well, casing string, and production string. For instance, holes may be created in the tubular member accidentally or intentionally. Alternatively, operators may find it beneficial to isolate certain zones. Regardless of the specific application, it is necessary to place certain downhole assemblies such as a liner patch within the tubular member, and in turn, anchor and seal the down hole assemblies within the tubular member.

Numerous devices have been attempted to create a seal and anchor for these downhole assemblies. For instance, U.S. Pat. No. 3,948,321 entitled "LINER AND REINFORCING SWAGE FOR CONDUIT IN A WELLBORE AND METHOD AND APPARATUS FOR SETTING SAME" to Owen et al, discloses a method and apparatus for emplacing a liner in a conduit with the use of swage means and a setting tool. The Owen et al disclosure anchors and seals the liner within the wellbore.

While conventional wellbore sealing devices have generally been adequate, situations may arise wherein such conventional sealing devices cannot be efficiently employed. For instance, an inner diameter of a well tubular may complicate the insertion of conventional sealing devices. In aspects, the present disclosure addresses these and other drawbacks of the prior art.

SUMMARY OF THE DISCLOSURE

In aspects, the present disclosure provides a well isolation apparatus for use in a wellbore. The apparatus may include a radially expandable sealing element configured to engage an interior wall of the wellbore tubular; a radially expandable expansion cone in telescopic relationship with the sealing element, the expansion cone being configured to expand the sealing element; and a swage configured to telescopically engage and expand the expansion cone.

The above-recited examples of features of the disclosure have been summarized rather broadly in order that the detailed description thereof that follows may be better understood, and in order that the contributions to the art may be appreciated. There are, of course, additional features of the disclosure that will be described hereinafter and which will form the subject of the claims appended hereto.

BRIEF DESCRIPTION OF THE DRAWINGS

For detailed understanding of the present disclosure, references should be made to the following detailed description of the preferred embodiment, taken in conjunction with the accompanying drawings, in which like elements have been given like numerals and wherein.

DETAILED DESCRIPTION OF THE DISCLOSURE

Figure 1:
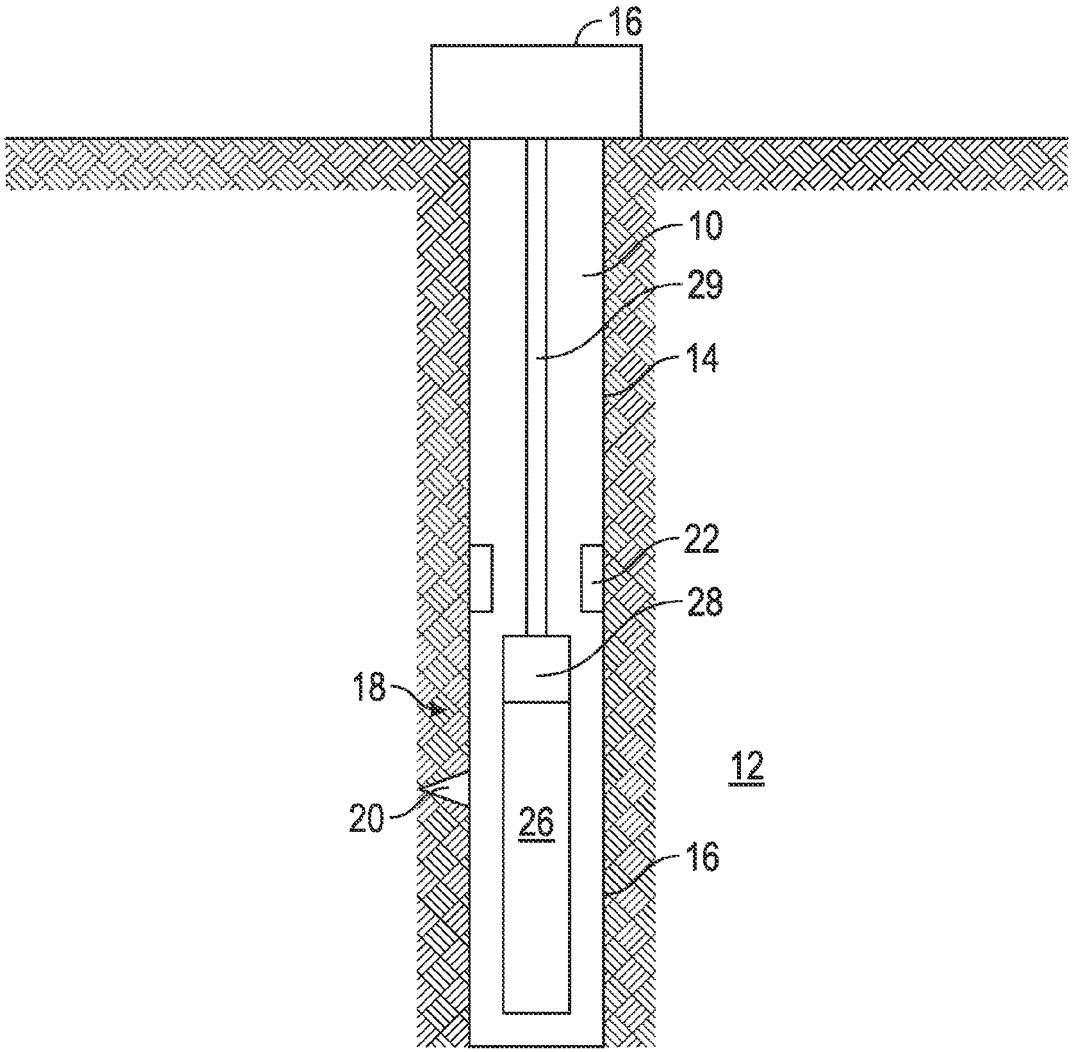
FIG. 1 is a schematic sectional view of one embodiment of an apparatus of the present disclosure as positioned within a wellbore intersecting a subterranean formation.

The present disclosure relates to devices and methods for anchoring one or more downhole tools and/or isolating a section of a wellbore. The present disclosure is susceptible to embodiments of different forms. There are shown in the drawings, and herein will be described in detail, specific embodiments of the present disclosure with the understanding that the present disclosure is to be considered an exemplification of the principles of the disclosure, and is not intended to limit the disclosure to that illustrated and described herein.

Referring now to FIG. 1, there is shown a well having wellbore 10 formed in a subterranean formation 12. The well may be horizontal, multi-lateral, slim hole, monobore or geothermal. The wellbore 10 includes a casing 14 that may be cemented in place. At the surface, a well head 16 and associated equipment are positioned over the wellbore 10. As is known, production fluids such as oil and gas flow up the wellbore 10 to the surface. In some situations, a zone 18 in the wellbore 10 may require isolation to prevent wellbore fluids such as drilling fluid invading a production zone, formation fluids (e.g., water) from entering the wellbore 10, and/or to stabilize wellbore tubulars. Such undesirable fluid flow or tubular instability can arise due to discontinuities 20 (e.g., human made perforations, corrosion, etc.). In some instances, conveying remediation tools to the zone 18 may be complicated by one or more reduced diameter sections 22 that limit the outer diameter of tools that can be conveyed to the zone 18.

Embodiments of the present disclosure include a diametrically compact well isolation system 26 that may be used to provide long-term isolation/strength at perforations, splits, corrosion and/or leaks in wellbore tubulars (e.g., casing, liner, production tubing, etc.) in such situations. The well isolation system 26 may include an isolator 30 that is activated by a setting tool 28. The well isolation system 26 may be tripped into the wellbore via a suitable conveyance device 29 (e.g., electric/wire line, slick line, tubing, drill pipe or coil tubing).

The setting tool 28 may be a known device that generates axial loadings. The setting tool 28 may be energized using electrical power, pressurized fluid, energetic material, or any other known method. As will be described in greater detail below, the wellbore isolation system 26 may be sized to pass through downhole restrictions, but have a range of diametrical expansion that enables engagement with an internal diameter of a casing 14 or other downhole well tubular. Additionally, the wellbore isolation system 26 may utilize multiple expanding components to provide a progressively stacked sealing assembly.

Figure 2A:
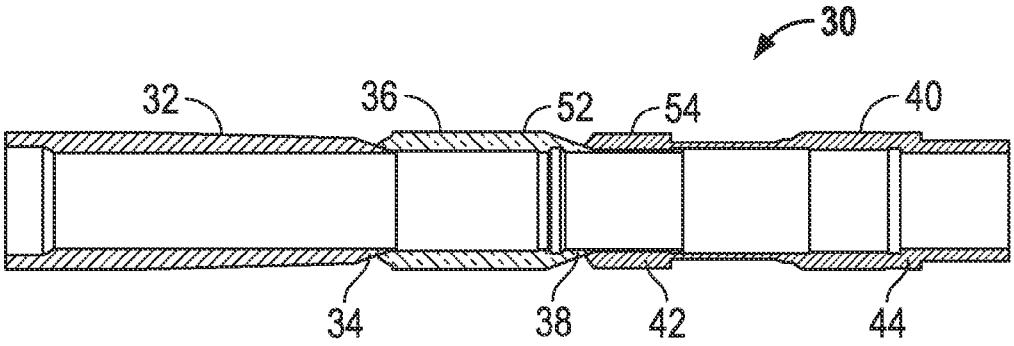
FIGS. 2A-C illustrate one embodiment of a well isolator in accordance with the present disclosure in various stages of installation.
Figure 2B:
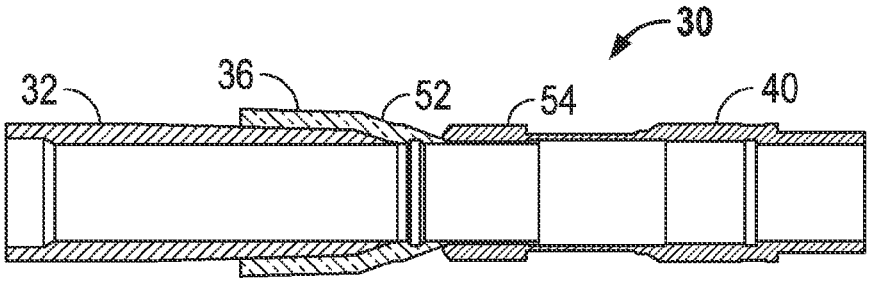
Figure 2C:
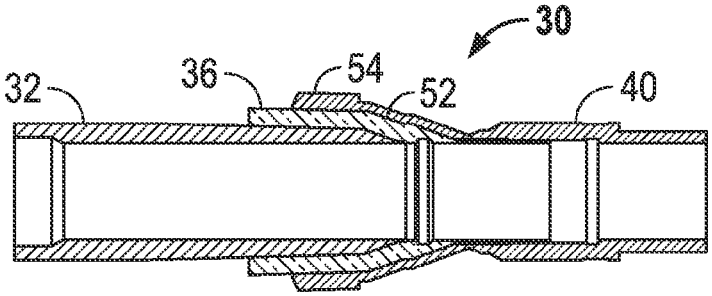

Referring now to FIGS. 2A-C, there is shown in greater detail one embodiment of a wellbore isolator 30 that may be used to isolate a desired section of a well. FIG. 2A depicts the isolator 30 when running in hole and prior to setting. The isolator 30 may include a swage 32 that is a non-deforming tubular component with a tapered end 34, an expansion cone 36 that is a deformable element with a tapered end 38, and a sealing element 40 that is a deformable element that engages and seals against an internal surface of a wellbore tubular. The expansion cone 36 and the sealing element 40 may have flared ends for receiving an adjacent element. In one sense, the swage 32, the expansion cone 36, and the sealing element 40 may be serially aligned tubular members that telescopically engage one another. By telescopically, it is meant that one tube slides into a bore of an adjacent tube.

Figure 3A:
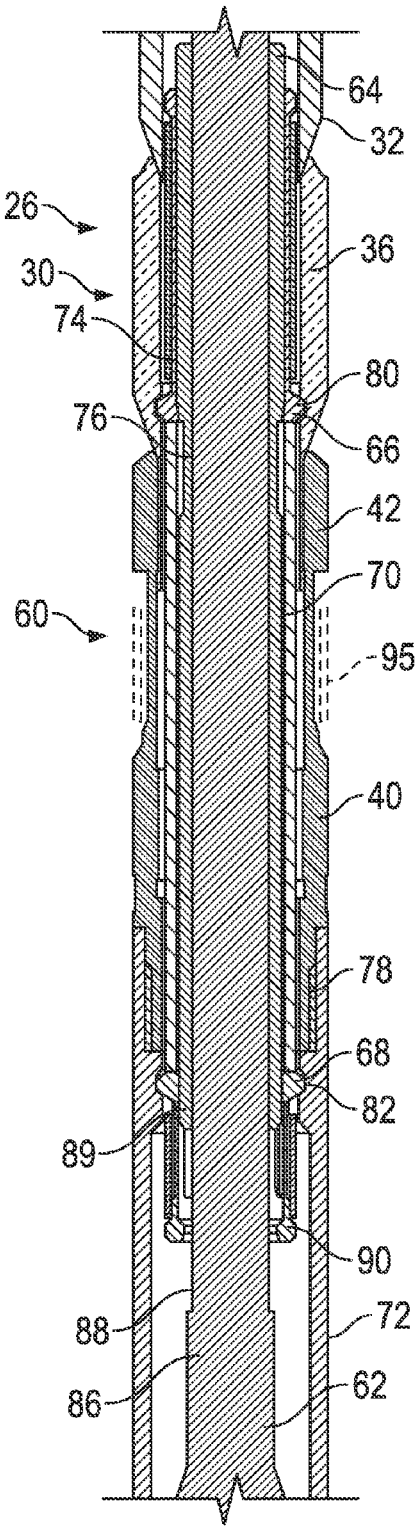
FIGS. 3A-C illustrate one embodiment of a well isolation system in accordance with the present disclosure for deploying the FIGS. 2A-C well isolator.
Figure 3B:
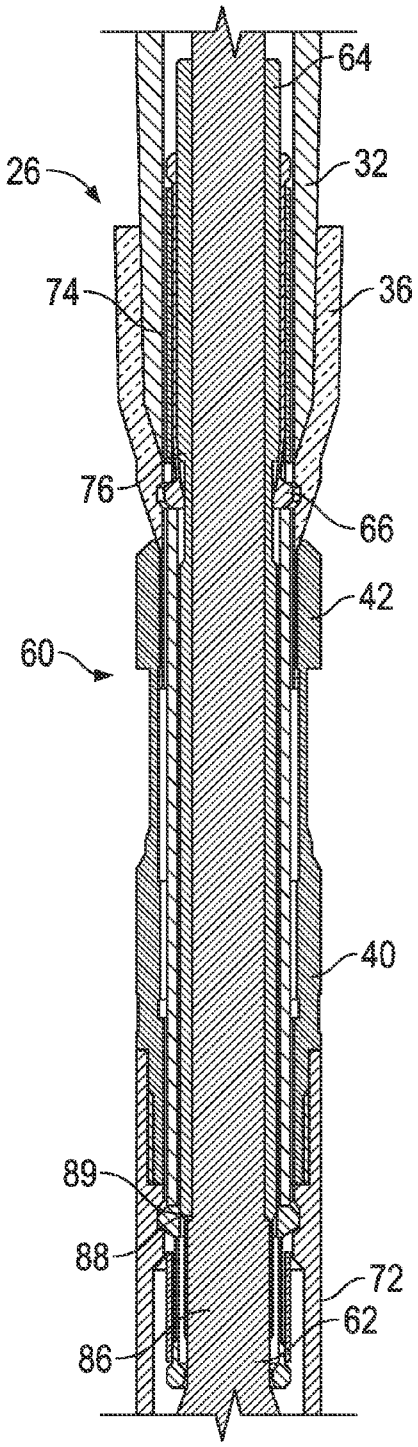

The sealing element 40 may include a seal section 42 that is configured to anchor and/or seal against a desired well tubular surface. The seal section 42 may include circumferential ribs, o-rings, or other features to provide a suitable fluid tight (e.g., liquid tight or gas tight) seal. The sealing element 40 may also include a connector end 44 shaped to receive or connect with additional elements (e.g., a profile sub 90 of FIG. 3A).

Referring now to FIG. 2B, the swage 32 is shown after being axially driven into flared end of the expansion cone 36 and before expansion of the sealing element 40. Because the swage 32 is made of a material that is harder or more rigid than that of the expansion cone 36, an outer surface 52 of the expansion cone 36 expands diametrically outward from a first diameter (shown in FIG. 2A) to a larger second diameter.

Referring now to FIG. 2C, the swage 32 and the expansion cone 36 are shown after being axially driven into the sealing element 40. Because the swage 32 is also made of a material that is harder or more rigid that that of the sealing element 40, an outer surface 54 of the seal section 42 expands also diametrically outward from a first diameter (shown in FIG. 2B) to a larger second diameter. The expansion cone 36 may also be formed of a material that is harder or more rigid than that of the sealing element 40.

It should be appreciated that the expanded diameter of the sealing element 40 is larger than that obtainable by inserting only the swage 32 or the expansion cone 36 into the sealing element 40. That is, the combined radial thicknesses of the swage 32 and expansion cone 36 allow the sealing element 40 to be expanded to an outer diameter larger than that otherwise achievable. Advantageously, the combined radial thickness of the swage 32 and expansion cone 36 only occurs after the isolator 30 has already passed through the reduced diameter section 22 shown in FIG. 1.

Referring now to FIGS. 1 and 3A-C, there are shown further aspects of the wellbore sealing system 26. The wellbore isolation system 26 may include an actuator assembly 60 that causes a sequential engagement between the swage 32, expansion cone 36, and the sealing element 40 of the isolator 30. The actuator assembly 60 may be operated using the setting tool 28 (FIG. 1). By sequential, it is meant that the start of each engagement that causes radial expansion is staggered in time.

In one embodiment, the actuator assembly 60 may include a timing rod 62, a release sleeve 64, an upper locking member 66, a lower locking member 68, a compression sleeve 70, and a profile sub 72. The timing rod 62 may be a rigid elongated element that is telescopically received into the tube-shaped release sleeve 64. The timing rod 62 is connected to the setting tool 28 (FIG. 1) such that the timing rod 62 may be pulled upward, or more generally, in a direction opposite to the movement of the swage 32. The release sleeve 64 may include an enlarged outer diameter portion 74 that maintains the upper locking member 66 in an engaged position and a smaller diameter necked portion 76 that allows the upper locking member 66 to radially retract into a disengaged position.

The locking members 66, 68 and the compression sleeve 70 cooperate to transfer axial loadings from the expansion cone 36 to the profile sub 72. The profile sub 72 may be connected to the sealing element 40 via a suitable connection, such as mating threads 78. In one arrangement, the locking members 66, 68 may be collets or other selectively anchoring devices that can extend and retract radially. The upper locking member 66 may be positioned to engage a suitable recess 80 in the expansion cone 36 and the lower locking member 68 may be positioned to engage a recess 82 in the profile sub 72. The compression sleeve 70 is nested between the upper and lower locking members 66, 68.

During the initial phase of installation, the axial loading caused by the swage 32 entering the expansion cone 36 is transferred to the upper locking member 66. The upper locking member 66 transmits the loading to the compression sleeve 70, which then axially loads the lower locking member 68. The lower locking member 68 transfers the load to the profile sub 72. Thus, the axial loading caused by the swage 32 is not initially applied to the sealing element 40.

An exemplary operation of the wellbore sealing system 30 will be discussed with reference to FIGS. 1, 3A-C. The wellbore sealing system 26 may be positioned at the selected location 18 in the wellbore 10 using the conveyance device 29. It should be appreciated that the relatively small cross-sectional profile of the unassembled wellbore isolation system 26 allows passage through bore restrictions 22. Once properly positioned, the setting tool 28 is activated by a suitable power source (e.g., pressurized fluid, electricity, energetic material, etc.) to drive the swage 32 into the expansion cone 36. The upper locking member 66 keeps the expansion cone 36 stationary by transferring the axial loading caused by the swage 32 to the profile sub 72 via the compression sleeve 70 and the lower locking member 68. As the swage 32 slides into the expansion cone 36, the expansion cone 36 increases in diametrical size.

While the setting tool 28 is driving the swage 32 into the expansion cone 36, the setting tool 28 is also pulling the timing rod 62 upward or in an axial direction opposite to that of the swage 32. The timing rod 62 includes a shoulder 86 at a lower end 88 that can interferingly engage an end 89 of the release sleeve 64. Upon engagement, the timing rod 62 pushes the release sleeve 64 axially upward. The axial translation of the release sleeve 64 slides the enlarged outer diameter portion 74 out from under the upper locking member 66. Soon thereafter, the necked portion 76 slides under the upper locking member 66 and allows the upper locking member 66 to retract into the necked portion 76. Thus, the expansion cone 36 is released and free to slide into the seal section 42 of the sealing element 40.

The stroke speed of timing rod 62 is selected to provide a travel time sufficient to allow the swage 32 to substantially telescopically engage a substantial section of the expansion cone 36. That is, the speed is selected such that the travel time needed for the shoulder 86 to contact the release sleeve 64 and the travel time needed for the necked portion 76 to slide under the upper locking member 66 is sufficient to allow the swage 32 to expand the expansion cone 36 to a functionally effective state. Specifically, the swage 32 expands enough of the expansion cone 36 such that subsequent engagement with the seal section 42 allows the seal element 40 to have a desired seal engagement with an adjacent surface. Thus, the swage 32, the expansion cone 36, and the sealing element 40 have translated from an axially, serially aligned arrangement to a primarily concentrically aligned compacted arrangement.

Figure 3C:
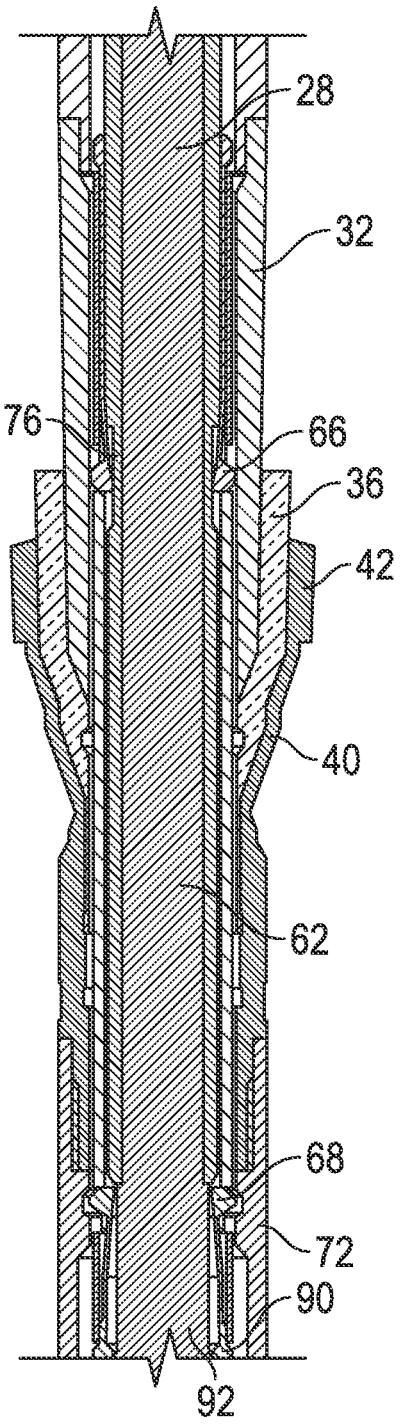

Referring now to FIG. 3C, the swage 32 and the expansion cone 36 are shown in an installed position within the sealing element 40. The sealing element 40 has been expanded radially outward into sealing engagement with an adjacent surface (not shown). As can be seen, the setting tool 28 has axially compressed the isolator 30 to a concentric alignment of swage 32, the expansion cone 36, and the sealing element 40 at the seal formed between the sealing element and an adjacent surface in the wellbore.

To complete the installation, the setting tool 28 continues to pull the timing rod 62 upward until contact is made with a release ring 90. A release ring 90 may be an annular member that is configured to retract the lower locking member 68. The release ring 90 is disposed uphole of an enlarged head 92 of the timing rod 62 and is shaped to engage and retract the lower locking member 68. As the timing rod 62 travels upward, the enlarged head 92 engages and drives the release ring 90 axially into the lower locking member 68. The pressure applied by the release ring 90 retracts the lower locking member 68 to disengage from the profile sub 72. The upper locking member 66 has already been retracted. At this point, further upward movement of the timing rod 62 lifts the components internal to the well isolator 30 upward. At the appropriate time, the setting tool and these internal elements may be retrieved to the surface using the conveyance device 29 or some other suitable means.

As use throughout, the term "radially expandable" or "diametrically" expandable means that the expansion is an engineered attribute that is expressly intended to perform a specific function. As discussed above, the function may be to induce a compressive sealing engagement.

It should be understood that the devices according to the present disclosure are susceptible to various embodiments. For example, Referring to FIG. 3A, in certain embodiments, a support sleeve 95 may be used to strengthen one or more sections of the isolator 30. The sleeve 95 may be a tubular member that is flexible enough to diametrically expand while at the same time applying a compressive force sufficient to reduce buckling, rupture, or other type of failure of the underlying structure. It should be understood that a sleeve is merely illustrative of support elements that may be used to reinforce one more more sections of the isolator 30. Other support elements, include, but are not limited to, bands, rings, clamps, etc.

The foregoing description is directed to particular embodiments of the present disclosure for the purpose of illustration and explanation. It will be apparent, however, to one skilled in the art that many modifications and changes to the embodiment set forth above are possible without departing from the scope of the disclosure. Thus, it is intended that the following claims be interpreted to embrace all such modifications and changes.

The invention claimed is:

1. A well isolation apparatus for use in a wellbore, comprising:

an isolator conveyed into the wellbore by a conveyance device, the isolator including a swage, an expansion cone, and a sealing element in substantially serial alignment;

an actuator configured to sequentially engage the swage, expansion cone, and the sealing element, wherein the actuator includes:

a sub connected to the sealing element, a compression sleeve transferring an axial loading on the expansion cone to the sub, a first locking member connecting the compression sleeve to the expansion cone, a second locking member connecting the compression sleeve to the sub, a release sleeve having a first diameter configured to retain the first locking member in an engaged position with the expansion cone, the release sleeve further comprising a reduced diameter neck, and a translating rod configured to shift the release sleeve to slide the neck into engagement with the first locking member; and a setting tool configured to axially compress the isolator to a concentric alignment of the swage, the expansion cone, and the sealing element at a seal formed between the sealing element and an adjacent surface in the wellbore.

2. The well isolation apparatus according to claim 1, wherein:

the sealing element is a radially expandable tubular having a seal section engaging the adjacent surface;

the expansion cone is a radially expandable tubular having a tapered end sliding into the seal section and a flared end for receiving the swage; and the swage is a tubular having a tapered end sliding into the expansion cone.

3. A well isolation apparatus for use in a wellbore, comprising:

a radially expandable sealing element configured to engage an interior wall of a wellbore tubular;

a radially expandable expansion cone in telescopic relationship with the sealing element, the expansion cone being configured to expand the sealing element;

an actuator configured to sequentially engage the sealing element, the expansion cone, and the swage, wherein the actuator includes a compression sleeve configured to transfer an axial loading on the expansion cone to a sub connected to the sealing element;

a first locking member connecting the compression sleeve to the expansion cone, and a second locking member connecting the compression sleeve to the sub;

a release sleeve having a first diameter configured to retain the first locking member in an engaged position with the expansion cone, the release sleeve further comprising a reduced diameter neck; and a swage configured to telescopically engage and expand the expansion cone.

4. The apparatus of claim 3, further comprising a translating rod configured to shift the release sleeve to slide the neck into engagement with the first locking member.

5. The apparatus of claim 3, wherein the sealing element includes at least one of:

(i) a circumferential rib, and (ii) an O-ring.

6. The apparatus of claim 3, wherein the swage and the expansion cone are formed of a material that is harder than a material of the sealing element.

7. The apparatus of claim 3, wherein:

the sealing element is a radially expandable tubular having a seal section engaging the adjacent surface;

the expansion cone is a radially expandable tubular having a tapered end sliding into the seal section and a flared end for receiving the swage; and the swage is a tubular having a tapered end sliding into the expansion cone.

8. A method for isolating a section of a tubular in a wellbore, comprising:

disposing an isolator, an actuator, and a setting tool in the tubular, wherein the isolator includes a swage, an expansion cone, and a sealing element in substantially serial alignment, wherein the actuator includes a sub connected to the sealing element and a compression sleeve configured to transfer an axial loading on the expansion cone to the sub;

connecting the compression sleeve to the expansion cone with a first locking member;

connecting the compression sleeve to the sub with a second locking member;

retaining the first locking member in an engaged position with the expansion cone and a release sleeve having a reduced diameter neck;

sequentially engaging the swage, expansion cone, and the sealing element using the actuator; and activating the setting tool to axially compress the isolator to concentrically align the swage, the expansion cone, and the sealing element at a seal formed between the sealing element and an adjacent surface of the tubular.

9. The method of claim 8, further comprising removing the actuator and the setting tool from the wellbore.

10. The method of claim 8, further comprising energizing the setting tool using one of: (i) electrical power, (ii) pressurized fluid, and (iii) an energetic material.

11. The method of claim 8, further comprising progressively stacking a plurality of sealing elements.

12. A well isolation apparatus for use in a wellbore, comprising:

a radially expandable sealing element configured to engage an interior wall of a wellbore tubular;

a radially expandable expansion cone in telescopic relationship with the sealing element, the expansion cone being configured to expand the sealing element;

an actuator configured to sequentially engage the sealing element, the expansion cone, and the swage, wherein the actuator includes: a sub connected to the sealing element, a compression sleeve configured to transfer an axial loading on the expansion cone to the sub, a first locking member connecting the compression sleeve to the expansion cone, and a second locking member connecting the compression sleeve to the sub, and a rod operatively engaging the first locking member and the second locking member; and a swage configured to telescopically engage and expand the expansion cone wherein the swage is configured to move in an axial direction that is opposite to the axial movement of the rod.

13. The apparatus of claim 12, wherein the sealing element includes at least one of: (i) a circumferential rib, and (ii) an O-ring.

14. The apparatus of claim 12, wherein the swage and the expansion cone are formed of a material that is harder than a material of the sealing element.

15. The apparatus of claim 12, wherein:

the sealing element is a radially expandable tubular having a seal section engaging the adjacent surface;

the expansion cone is a radially expandable tubular having a tapered end sliding into the seal section and a flared end for receiving the swage; and the swage is a tubular having a tapered end sliding into the expansion cone.

* * * * *